US007171931B2

(12) United States Patent
Todo et al.

(10) Patent No.: US 7,171,931 B2
(45) Date of Patent: Feb. 6, 2007

(54) VARIABLE VALVE SYSTEM WITH CONTROL SHAFT ACTUATING MECHANISM

(75) Inventors: Tamotsu Todo, Kanagawa (JP); Shinichi Kawada, Kanagawa (JP); Keisuke Takeda, Kanagawa (JP); Mikihiro Kajiura, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 11/435,758

(22) Filed: May 18, 2006

(65) Prior Publication Data

US 2006/0207536 A1 Sep. 21, 2006

Related U.S. Application Data

(63) Continuation of application No. 11/076,156, filed on Mar. 10, 2005, now Pat. No. 7,077,086.

(30) Foreign Application Priority Data

Mar. 24, 2004 (JP) ..... 2004-085905

(51) Int. Cl.
*F01L 1/34* (2006.01)

(52) U.S. Cl. ..... 123/90.16; 123/91.15; 123/90.17; 123/90.31

(58) Field of Classification Search ..... 123/90.16, 123/90.17, 90.15, 90.31
See application file for complete search history.

(56) References Cited

U.S. PATENT DOCUMENTS 6,513,467 B2 * 2/2003 Nohara et al. ..... 123/90.15
6,550,437 B2 * 4/2003 Nakamura et al. ..... 123/90.16
6,615,777 B2 9/2003 Grau

* cited by examiner

*Primary Examiner*—Thomas Denion
*Assistant Examiner*—Zelalem Eshete
(74) *Attorney, Agent, or Firm*—Foley & Lardner LLP

(57) ABSTRACT

A variable valve system varies an operation condition of an engine valve by controlling an angular position of a control shaft in accordance with an operation condition of the engine. The system has an actuating mechanism for actuating the control shaft. The actuating mechanism comprises a threaded shaft that is rotated about its axis in accordance with the operation condition of the engine; a nut member operatively engaged with the threaded shaft, so that upon rotation of the threaded shaft the nut member runs axially along the threaded shaft; a link mechanism provided between the control shaft and the nut member, so that the axial movement of the nut member along the threaded shaft induces a rotational motion of the control shaft; and a biasing mechanism that biases the nut member relative to the threaded shaft at least at a predetermined range of the operation condition of the engine valve.

6 Claims, 16 Drawing Sheets

VARIABLE VALVE SYSTEM WITH CONTROL SHAFT ACTUATING MECHANISM

CROSS-REFERENCE TO RELATED APPLICATIONS

This application is a continuation of, and incorporates herein by reference, U.S. patent application Ser. No. 11/076,156, filed Mar. 10, 2005 now U.S. Pat. No. 7,077,086.

BACKGROUND

The present invention relates in general to variable valve systems of an internal combustion engine, which have a valve lift degree varying mechanism to vary a lift degree or work angle of engine valves (viz., intake and/or exhaust valves) in accordance with an operation condition of the engine, and more particularly to the variable valve systems of a type that has an actuating mechanism for actuating a control shaft of the valve lift degree varying mechanism.

Hitherto, in the field of variable valve systems, various types of actuating mechanisms for actuating the control shaft of the valve lift degree varying mechanism have been proposed and put into practical use. One of them is shown in U.S. Pat. No. 6,615,777 granted on Sep. 9, 2003.

The actuating mechanism of the U.S. patent generally comprises a threaded shaft that is driven by an electric motor, a screw nut that is operatively engaged with the threaded shaft, a link member that has at one end two arms pivotally connected to diametrically opposed ends of the screw nut through bearing pins, and an adjusting lever member that has one end pivotally connected to the other end of the link member and the other end connected to a control shaft. The control shaft has control or adjusting cams integrally connected thereto.

When, upon energization of the electric motor, the threaded shaft is rotated about its axis, the screw nut is moved axially forward or rearward along the threaded shaft pivotally actuating the link member and the lever member. With this, the control shaft is turned about its axis to a desired angular position.

However, due to its inherent construction, the actuating mechanism of the above-mentioned US patent tends to show the following drawbacks under operation of the engine.

That is, when, because of the biasing force of valve springs that biases intake or exhaust valves in a closing direction, the control shaft is applied with an alternating torque, the adjusting lever member and the link member function to transmit the alternating torque to the screw nut. However, the torque transmission to the screw nut tends to induce a backlash of the screw nut relative to the threaded shaft. Of course, such backlash is undesirable because it induces not only noises of the screw nut but also a premature wear of the threads of the screw nut and the threaded shaft.

SUMMARY

Accordingly, it is an object of the present invention to provide a variable valve system with a control shaft actuating mechanism, which is free of the above-mentioned drawback.

In accordance with a first aspect of the present invention, there is provided a variable valve system of an internal combustion engine for varying an operation condition of an engine valve by controlling an angular position of a control shaft in accordance with an operation condition of the engine. The system comprises an actuating mechanism for actuating the control shaft, the actuating mechanism comprising a threaded shaft that is rotated about its axis in accordance with the operation condition of the engine; a nut member operatively engaged with the threaded shaft, so that upon rotation of the threaded shaft the nut member runs axially along the threaded shaft; a link mechanism provided between the control shaft and the nut member, so that the axial movement of the nut member along the threaded shaft induces a rotational motion of the control shaft; and a biasing mechanism that biases the nut member relative to the threaded shaft at least at a predetermined range of the operation condition of the engine valve.

In accordance with a second aspect of the present invention, there is provided a variable valve system for varying an operation condition of an engine valve that is biased in a valve closing directing by a valve spring. The system comprises a valve lift degree varying mechanism that varies the operation condition of the engine valve in accordance with an angular position assumed by a control shaft; a threaded shaft rotatable about its axis; a drive mechanism that rotates the threaded shaft in accordance with an operation condition of the engine; a nut member operatively engaged with the threaded shaft, so that upon rotation of the threaded shaft, the nut member rungs axially along the threaded shaft; a link mechanism provided between the control shaft and the nut member, so that the axial movement of the nut member along the threaded shaft induces a rotational motion of the control shaft; and a biasing member that produces a biasing force by which respective threads of the nut member and the threaded shaft are biased toward each other in an axial direction.

In accordance with a third aspect of the present invention, there is provided a variable valve system for varying an operation condition of an engine valve that is biased in a valve closing directing by a valve spring. The system comprises a valve lift degree varying mechanism that varies the operation condition of the engine valve in accordance with an angular position assumed by a control shaft; a threaded shaft rotatable about its axis; a drive mechanism that rotates the threaded shaft in accordance with an operation condition of the engine; a nut member operatively engaged with the threaded shaft, so that upon rotation of the threaded shaft, the nut member rungs axially along the threaded shaft; a link mechanism provided between the control shaft and the nut member, so that the axial movement of the nut member along the threaded shaft induces a rotational motion of the control shaft; and a guide member that, upon need of starting the engine, guides the nut member to such a position as to cause the engine valve to take such an operation condition as to enable the starting of the engine.

Other aspects and objects of the present invention will become apparent from the following description when taken in conjunction with the accompanying drawings.

BRIEF DESCRIPTION OF THE DRAWINGS

FIGS. 9A and 9B are views taken from the direction of the arrow "C" of FIG. 8, in which FIG. 9A shows a valve closing condition under the lowest lift of the intake valves, and FIG. 9B shows a valve opening condition under the lowest lift of the intake valves;

FIGS. 10A and 10B are views similar to FIGS. 9A and 9B, but in which FIG. 10A shows a valve closing condition under the highest lift of the intake valves, and FIG. 10B shows a valve opening condition under the highest lift of the intake valves;

DETAILED DESCRIPTION

In the following, four embodiments 100, 200, 300 and 400 of the present invention will be described in detail with reference to the accompanying drawings.

For ease of understanding, various directional terms, such as, right, left, upper, lower, rightward and the like are used in the following description. However, such terms are to be understood with respect to only a drawing or drawings on which corresponding part or portion is shown. Throughout the description, substantially same parts or portions are denoted by the same numerals and repetitive explanation on them will be omitted for simplification of the description.

Referring to FIGS. 1 to 8, 9A, 9B, 10A and 10B of the drawings, there is shown partially or entirely a variable valve system 100 of a first embodiment of the present invention.

Before describing the detail of the invention, the entire construction of variable valve system 100 will be described with reference to FIGS. 5, 6, 7, 8, 9A, 9B, 10A and 10C.

Figure 5:
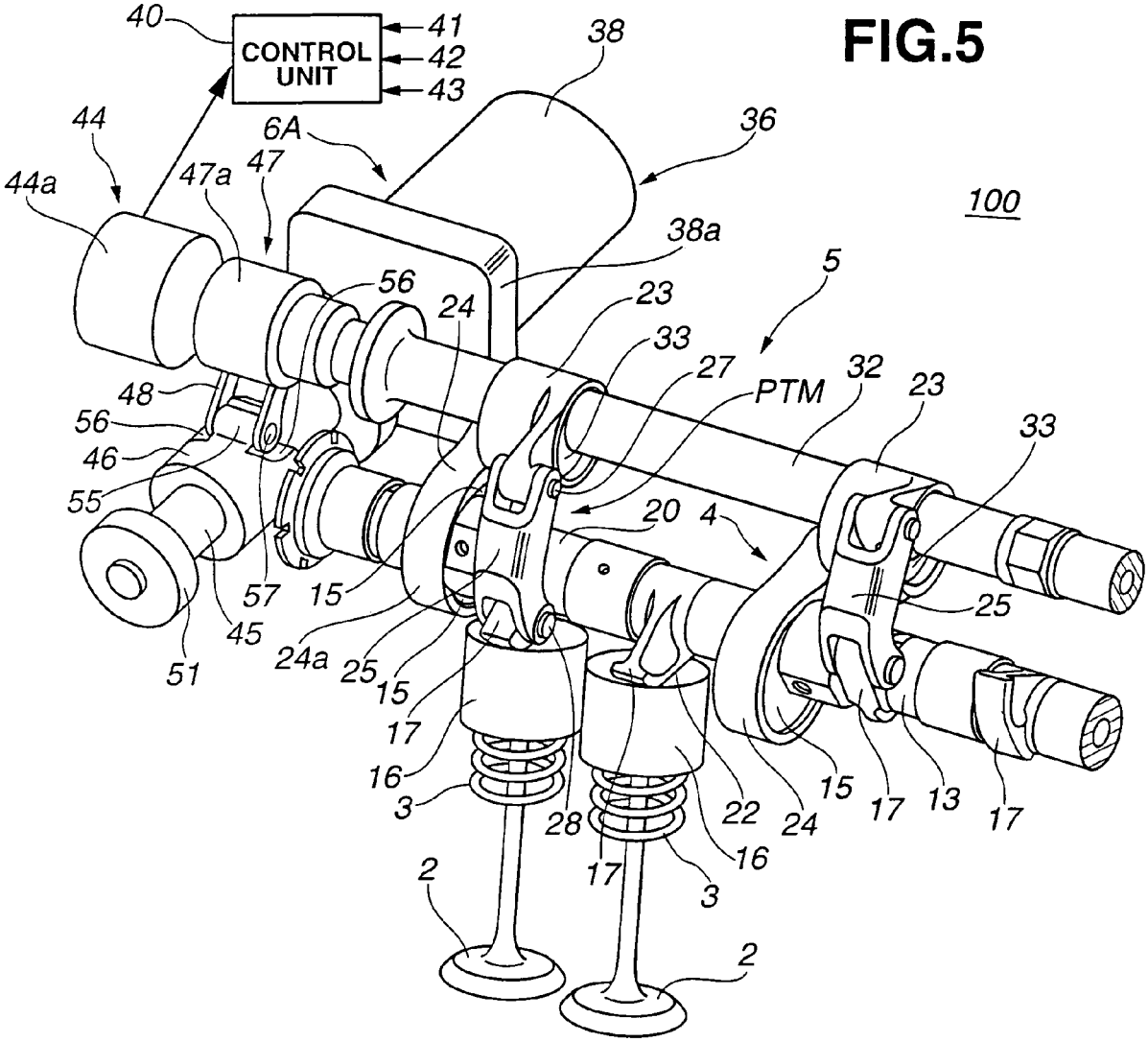
FIG. 5 is a perspective view of the variable valve system of the first embodiment, to which the actuating mechanism is practically applied.

As will be understood from FIG. 5, variable valve system 100 is designed to be applicable to multicylinder internal combustion engines of a type that has two intake valves 2 and 2 for each cylinder.

That is, variable valve system 100 is constructed to control operation of paired intake valves 2 and 2 (viz., engine valves) for each cylinder of the engine. Intake valves 2 and 2 are slidably guided by a cylinder head 1 (see FIG. 9A) through valve guides (not shown). Each intake valve 2 has a valve spring 3 for being biased in a closing direction, and has a valve lifter 16 mounted on a stem thereof.

As will be described in detail hereinafter, variable valve system 100 generally comprises a valve lift mechanism 4 that induces an open/close condition of intake valves 2 and 2, a valve lift degree varying mechanism 5 that is incorporated with valve lift mechanism 4 to vary a lift degree (or work angle) of intake valves 2 and 2 and an actuating mechanism 6A that actuates the valve lift degree varying mechanism 5 (more specifically, a control shaft 32 of this mechanism 5) in accordance with an operation condition of the engine.

It is to be noted that the work angle of engine valve 2 is an event corresponding to a period or span in terms of crank angle, that elapses from a time when the valve 2 is just opened to a time when the valve 2 is just closed in each operation cycle of the engine.

As is seen from FIG. 5, valve lift mechanism 4 comprises a hollow drive shaft 13 that is rotatably held on an upper portion of cylinder head 1 through bearings 14 (see FIG. 9A), a drive cam 15 (see FIGS. 6 and 8) for each cylinder, that is fixed, through a press-fitting or the like, to hollow drive shaft 13 to rotate therewith, two swing cams 17 and 17 for each cylinder, that are integrally mounted on a cylindrical camshaft 20 rotatably disposed on hollow drive shaft 13 and operatively contact with valve lifters 16 and 16 of intake valves 2 and 2 to induce an open/close operation of intake valves 2 and 2 and a power transmitting mechanism "PTM" that is arranged between drive cam 15 and each of swing cams 17 and 17 to transmit a torque of drive cam 15 to swing cams 17 and 17. Actually, due to an after-mentioned linkage construction of power transmitting mechanism "PTM", the rotary motion of drive cam 15 is converted to a swing motion of swing cams 17 and 17.

Hollow drive shaft 13 extends along an axis of the engine. Although not shown in the drawings, hollow drive shaft 13 has one end to which a torque is applied from a crankshaft of the engine through a sprocket fixed to the end of drive shaft 13 and a timing chain that is put around the sprocket and the crankshaft. That is, drive shaft 13 is driven or rotated by the crankshaft of the engine. Usually, an operation phase varying mechanism (not shown) is arranged between the crankshaft and drive shaft 13 for varying or controlling an operation phase of drive shaft 13 relative to the crankshaft of the engine.

Figure 9A:
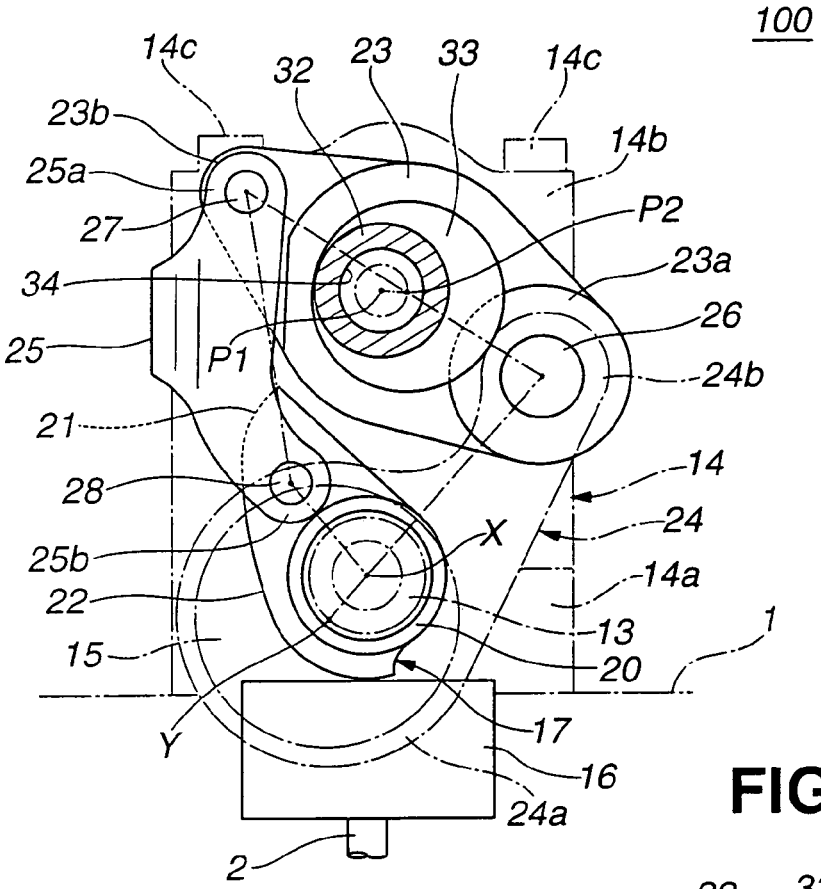

As is seen from FIG. 9A, each of bearings 14 comprises a main bracket 14*a* that is mounted on cylinder head 1 to rotatably support drive shaft 13, a sub-bracket 14*b* that is mounted on main bracket 14*a* to rotatably support an after-mentioned control shaft 32 and a pair of connecting bolts 14*c* and 14*c* that pass through both sub-bracket 14*b* and main bracket 14*a* to tightly connect these brackets 14*b* and 14*a* to cylinder head 1.

Figure 8:
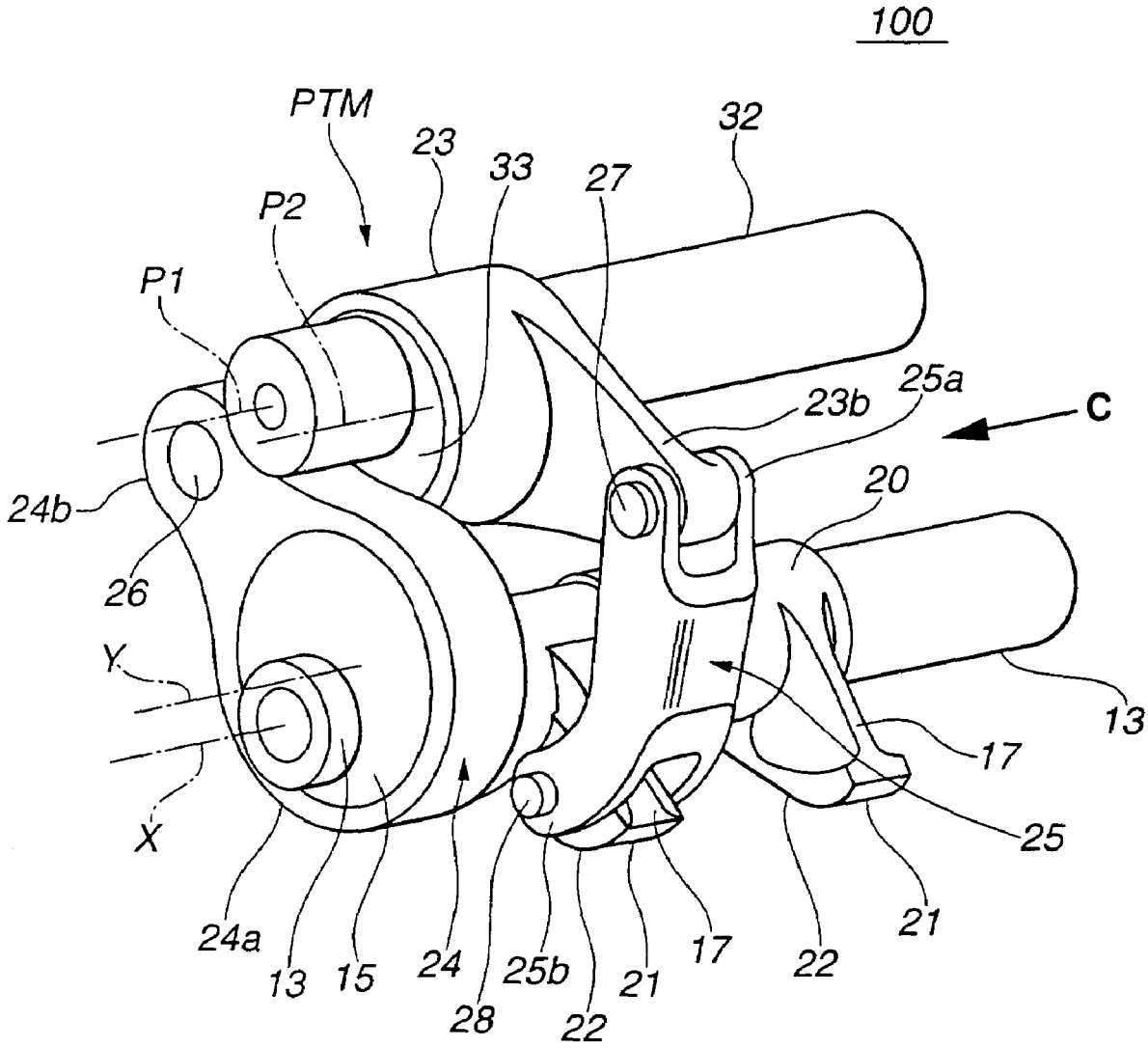
FIG. 8 is an enlarged perspective view of a part of the variable valve system.

As is best seen from FIG. 8, drive cam 15 is a circular disc that has a center axis "Y" displaced or eccentric from a center axis "X" of drive shaft 13. More specifically, the circular disc has at an eccentric portion thereof a circular opening through which drive shaft 13 passes. For the integral rotation of drive cam 15 with drive shaft 13, drive shaft 13 is secured to the circular opening of the drive cam 15 through press-fitting or the like.

As is seen from this drawing, two swing cams 17 and 17 are substantially the same in construction and have a generally triangular cross section. These two swing cams 17 and 17 are integrally mounted on axially opposed end portions of cylindrical camshaft 20 that is swingably disposed about hollow drive shaft 13, as shown. Each swing cam 17 has a cam nose portion 21 and a cam surface 22 at its lower side.

As is seen from FIG. 9A, cam surface 22 of each swing cam 17 includes a base round part that extends around the cylindrical outer surface of camshaft 20, a lump part that extends from the base round part toward cam nose portion 21 and a lift part that extends from the lump part to a maximum lift point defined at the leading end of cam nose portion 21. That is, under operation, these parts of cam surface 22 slidably contact an upper surface of the corresponding valve lifter 16 thereby to induce the open/close operation of the corresponding intake valve 2 in accordance with a swing movement of swing arms 17 and 17.

As is best seen from FIG. 8, power transmitting mechanism "PTM" comprises a rocker arm 23 that is pivotally disposed about control shaft 32 positioned above drive shaft 13, a link arm 24 that pivotally connects one wing part 23*a* (see FIG. 9A) of rocker arm 23 to drive cam 15, and a link rod 25 that pivotally connects the other wing part 23*b* of rocker arm 23 to one of swing cams 17 and 17.

As is seen from FIGS. 8 and 9A, rocker arm 23 has at its middle part a cylindrical bore (no numeral) in which an after-mentioned control cam 33 is rotatably disposed. As shown in FIG. 8, wing part 23*b* of rocker arm 23 is pivotally connected to one end of link rod 25 through a pivot pin 27. As is seen from FIG. 9A and understood from FIG. 8, the other wing part 23*a* of rocker arm 23 is pivotally connected to a radially projected arm portion 24*b* of link arm 24 through a pivot pin 26.

Figure 6:
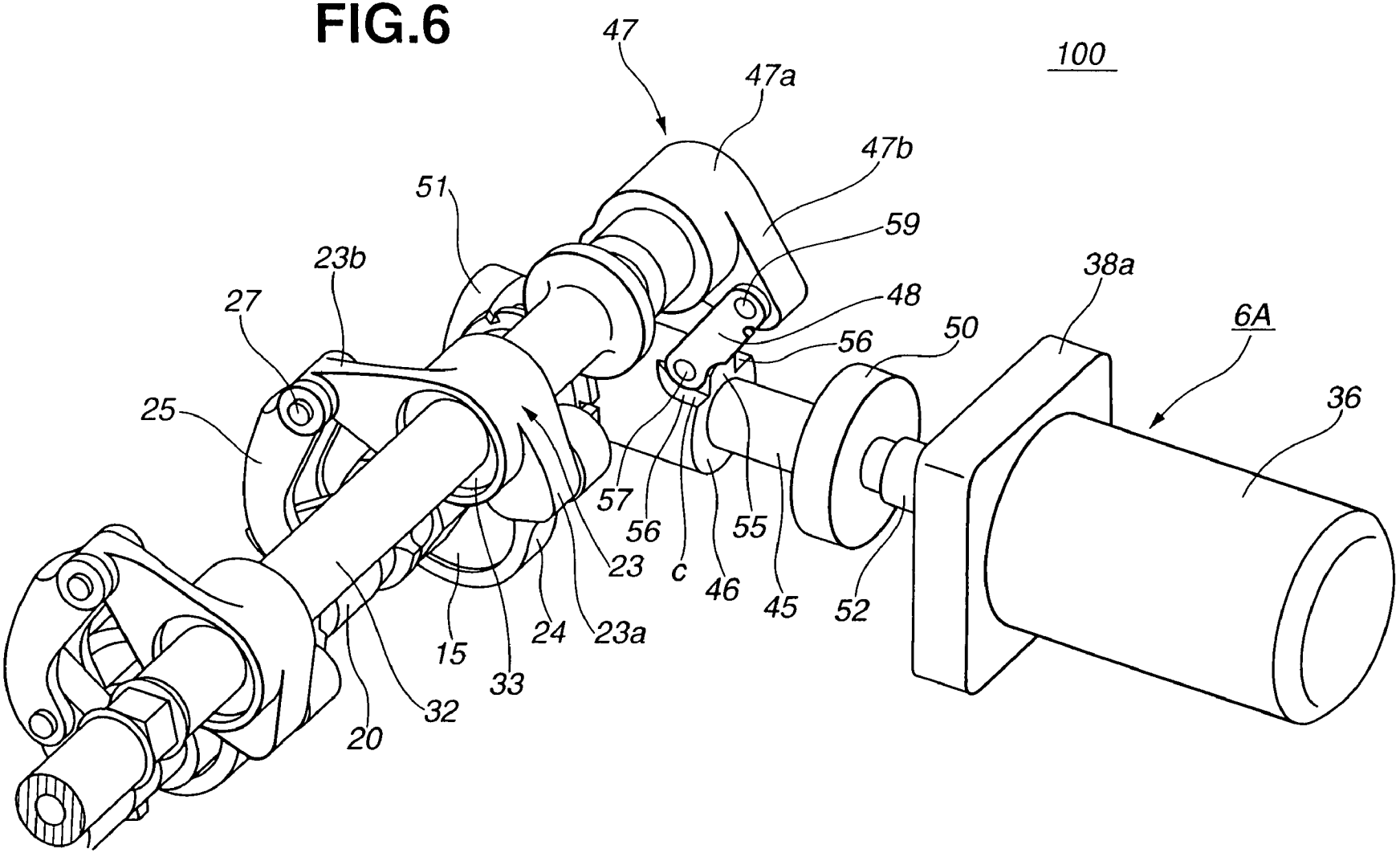
FIG. 6 is a perspective view of a part of the variable valve system of FIG. 5, that is taken from a different direction.
Figure 7:
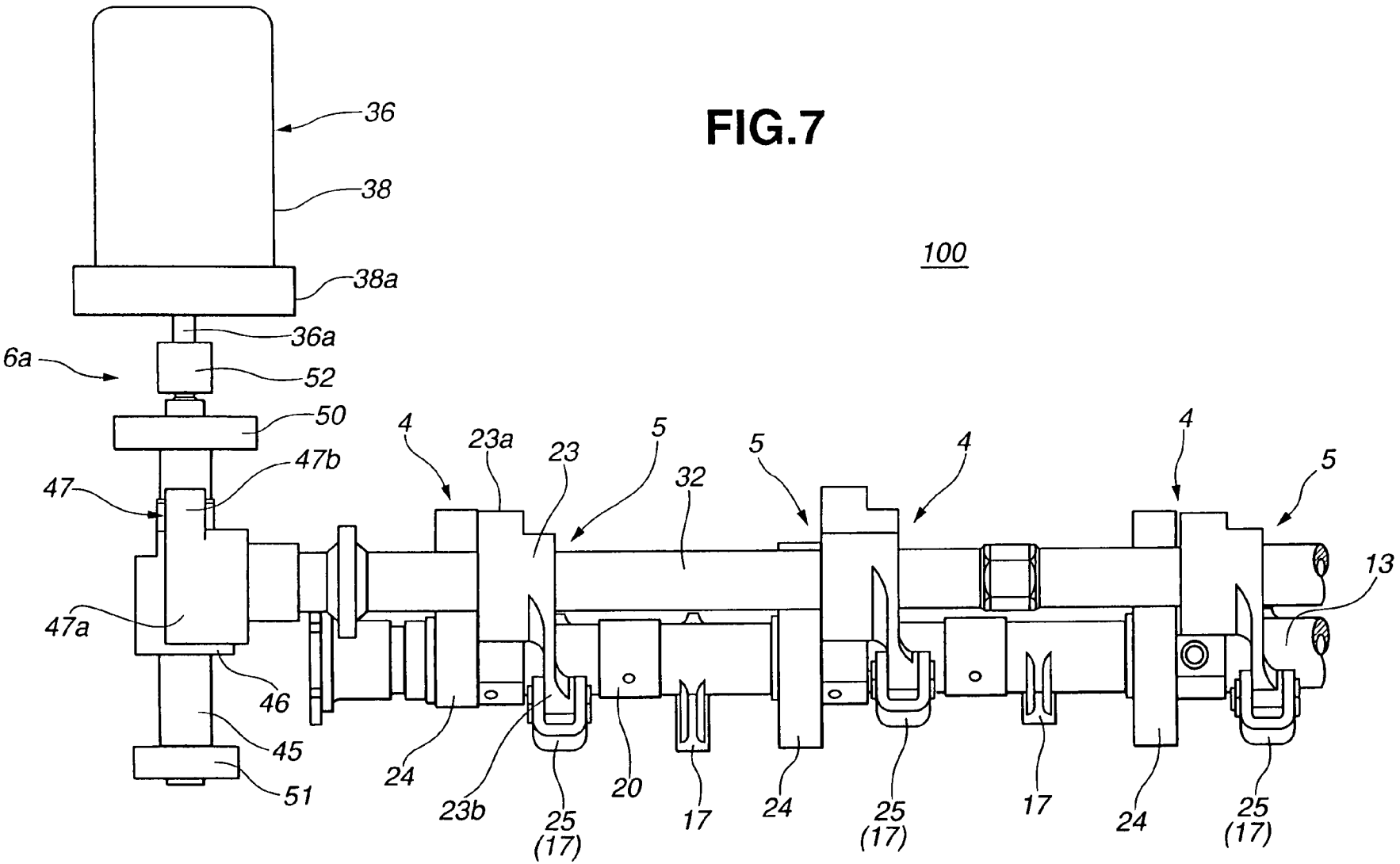
FIG. 7 is a plan view of the part of the variable valve system of FIG. 5.

As is seen from FIG. 6, the two wing parts 23*a* and 23*b* of rocker arm 23 extend radially outward from axially opposed end portions of the bored middle part of rocker arm 23.

Referring back to FIG. 8, link arm 24 comprises an annular base portion 24*a* that rotatably receives therein the above-mentioned drive cam 15 and the above-mentioned radially projected arm portion 24*b* that is pivotally connected to wing part 23*a* of rocker arm 23 through pivot pin 26.

As is best seen from FIG. 8, link rod 25 is a curved channel member that has an upper end 25*a* pivotally connected to wing part 23*b* of rocker arm 23 through pivot pin 27 and a lower end 25*b* pivotally connected to swing cam 17 through a pivot pin 28.

Although not shown in the drawings, pivot pins 26, 27 and 28 are equipped at one ends with respective snap rings for holding link arm 24 and link rod 25 at their properly set positions.

In the following, valve lift degree varying mechanism 5 will be described in detail with reference to the drawings.

As is seen from FIG. 5, valve lift degree varying mechanism 5 comprises control shaft 32 that extends in parallel with the above-mentioned drive shaft 13 and is rotatably held by bearings 14 (see FIG. 9A), and a control cam 33 for each cylinder, which is secured to control shaft 32 to rotate therewith. As is mentioned hereinabove, control cam 33 is rotatably disposed in the cylindrical bore provided in the middle part of rocker arm 23. That is, control cam 33 serves as a swinging fulcrum of rocker arm 23.

As is described hereinabove and seen from FIG. 9A, control shaft 32 is rotatably held between main-bracket 14*a* and sub-bracket 14*b* of each bearing 14 that is tightly mounted on cylinder head 1.

As is seen from FIG. 8, control cam 33 is a circular disc that has a center axis "P2" displaced or eccentric from a center axis "P1" of control shaft 32. More specifically, the circular disc has at an eccentric portion thereof a circular opening through which control shaft 32 passes. For the integral rotation of control cam 33 with control shaft 32, control shaft 32 is secured to the circular opening of control cam 33 through press-fitting or the like.

In the following, actuating mechanism 6A will be described with reference to the drawings, particularly FIGS. 1, 2 and 5. It is to be noted that actuating mechanism 6A shown in FIG. 5 has some parts removed for the purpose of clarifying the arrangement of essential elements of the mechanism 6A.

Figure 1:
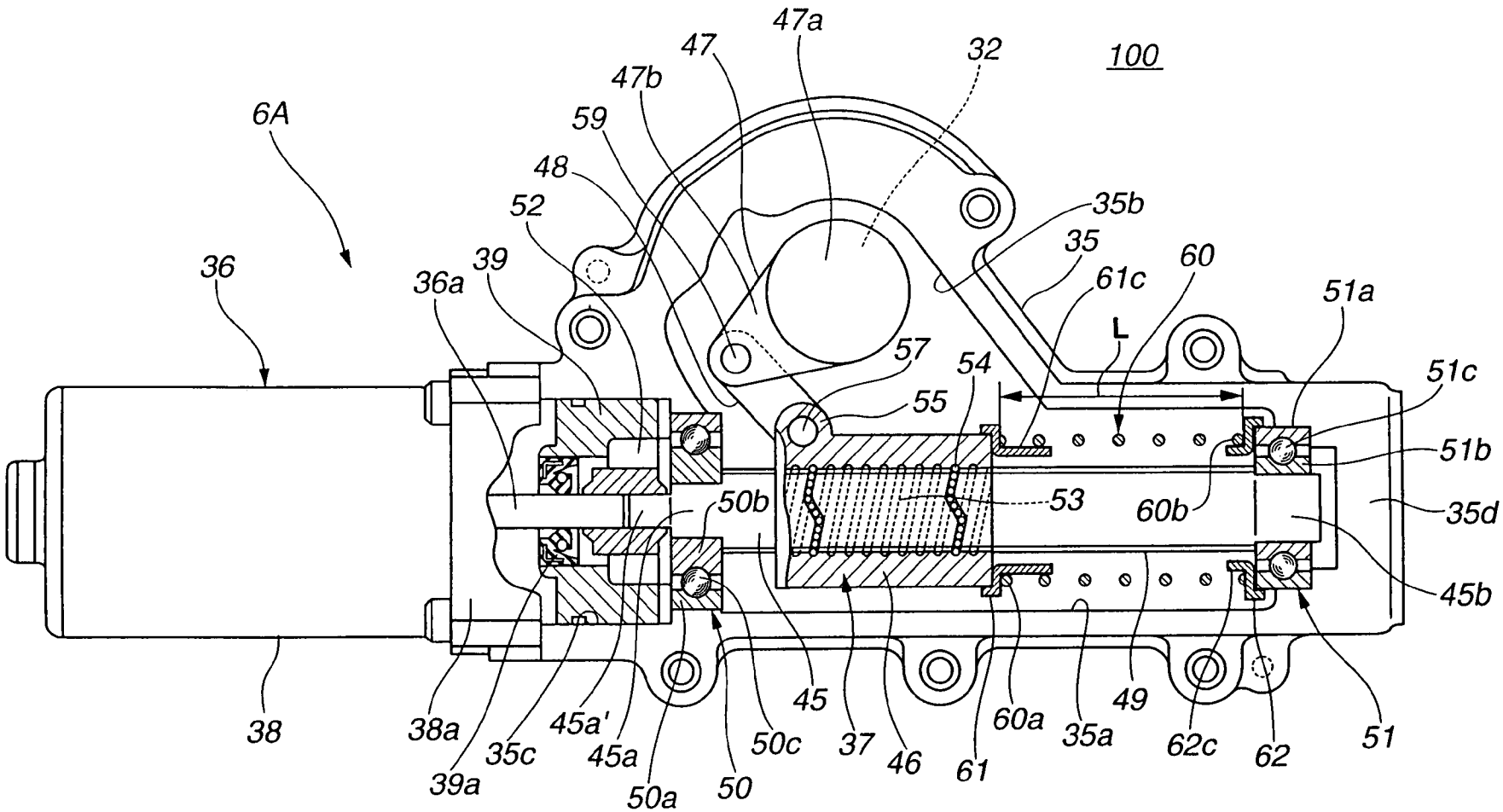
FIG. 1 is a vertically sectioned view of an actuating mechanism employed in a variable valve system of a first embodiment of the present invention.

As is understood from FIG. 1, actuating mechanism 6A comprises a cylindrical housing 35 (not shown in FIG. 5) that is mounted on one end of cylinder head 1 and extends perpendicular to control shaft 32 and thus to drive shaft 13, an electric motor 36 that is coaxially connected to one end of cylindrical housing 35, and a ball-screw type transmission mechanism 37 that is installed in cylindrical housing 35.

As will become apparent hereinafter, ball-screw type transmission mechanism 37 functions to transmit a torque of electric motor 36 to control shaft 32 to rotate control shaft 32 in a clockwise or counterclockwise direction in FIG. 1.

As is understood from FIG. 1, cylindrical housing 35 is constructed of an aluminum alloy or the like and includes generally an elongate lower bore 35*a* that extends axially along the housing 35 and an upper bore 35*b* that extends upward from a middle portion of elongate lower bore 35*a*. That is, these two bores 35*a* and 35*b* are merged to constitute a so-called part housing room. As shown, in elongate lower bore 35*a*, there is arranged the above-mentioned ball-screw type transmission mechanism 37, and into upper bore 35*b*, there is projected one end 32*a* of control shaft 32.

Although not shown in FIG. 1, the part housing room including the two bores 35*a* and 35*b* is covered by a cover member. As shown in this drawing, elongate lower bore 35*a* has a left end 35*c* opened and a right end closed by a wall 35*d*.

Electric motor 36 is of a DC type which comprises a cylindrical casing 38 that has an opened base end 38*a* tightly connected to the opened left end 35*c* of elongate lower bore 35*a*. Electric motor 36 has an output shaft 36*a* rotatably held by a retainer 39 tightly received in the opened left end 35*c*. For sealing output shaft 36*a*, there is used a mechanical seal 39*a* between retainer 39 and output shaft 36*a*.

As is seen from FIG. 5, electric motor 36 is controlled by a control unit 40. That is, control unit 40 outputs an instruction signal to electric motor 36 by processing various information signals fed thereto. These information signals are, for example, signals from a crank angle sensor 41, an air flow meter 42, an engine cooling water temperature sensor 43 and a rotation angle sensor 44 for control shaft 32. By processing these information signals, control unit 40 derives a current operation condition of the engine and outputs an instruction signal to electric motor 36 in accordance with the derived operation condition of the engine.

Referring back to FIG. 1, ball-screw type transmission mechanism 37 generally comprises a ball-screw shaft 45 that extends axially in elongate lower bore 35*a* and is coaxial with output shaft 36*a* of electric motor 36, a ball-nut 46 that is disposed about ball-screw shaft 45 to operatively engage the same, a connecting arm 47 that is secured to an end of control shaft 32 (see FIG. 5), and a link member 48 that pivotally connects connecting arm 47 and ball-nut 46. Connecting arm 47 and link member 48 thus constitute a transmission mechanism.

Ball-screw shaft 45 is formed with a threaded outer surface 49 except axially opposite end portions 45*a* and 45*b* thereof. As shown, opposite end portions 45*a* and 45*b* of ball-screw shaft 45 are rotatably held by left and right ball bearings 50 and 51 which are tightly held in elongate lower bore 35*a*.

As shown, left ball bearing 50 comprises an outer race 50*a* that is press-fitted in the bore 35*a* near the opened left end 35*c*, an inner race 50*b* that holds the left end portion 45*a* of ball-screw shaft 45 and balls 50*c* that are operatively received between outer and inner races 50*a* and 50*b*, and right ball bearing 51 comprises an outer race 51*a* that is press-fitted in a diametrically reduced right end of the bore 35*a*, an inner race 51*b* that holds the right end portion 45*b* of ball-screw shaft 45 and balls 51*c* that are operatively received between outer and inner races 51*a* and 51*b*.

Left end portion 45*a* of ball-screw shaft 45 has a hexagonal head 45*a*' that is axially movably received in a hexagonal socket 52 that is fixed to a leading end of output shaft 36*a* of electric motor 36. Thus, output shaft 36*a* and ball-screw shaft 45 can rotate together like a unit while being permitted to move axially relative to each other.

Ball-nut 46 is engaged or meshed with ball-screw shaft 45 so that rotation of ball-screw shaft 45 about its axis induces a forward or rearward movement of ball-nut 46 along ball-screw shaft 45. That is, ball-nut 46 is a cylindrical member that has a bore whose inner surface is formed with a spiral thread 53 that is meshed with a spiral thread 49 formed on the outer surface of ball-screw shaft 45. A plurality of fine balls 54 are operatively received in spiral thread 53 of ball-nut 46 for achieving a smoothed movement of ball-nut 46 along ball-screw shaft 45. Two deflectors (no numerals) are provided by spiral thread 53 of ball-nut 46 to produce an endless screw passage of the threads in and along which fine balls 54 run endlessly under movement of ball-nut 46 along ball-screw shaft 45.

Thus, in operation, rotation of ball-screw shaft 45 about its axis is converted to the axial movement of ball-nut 46 through fine balls 54.

Figure 2:
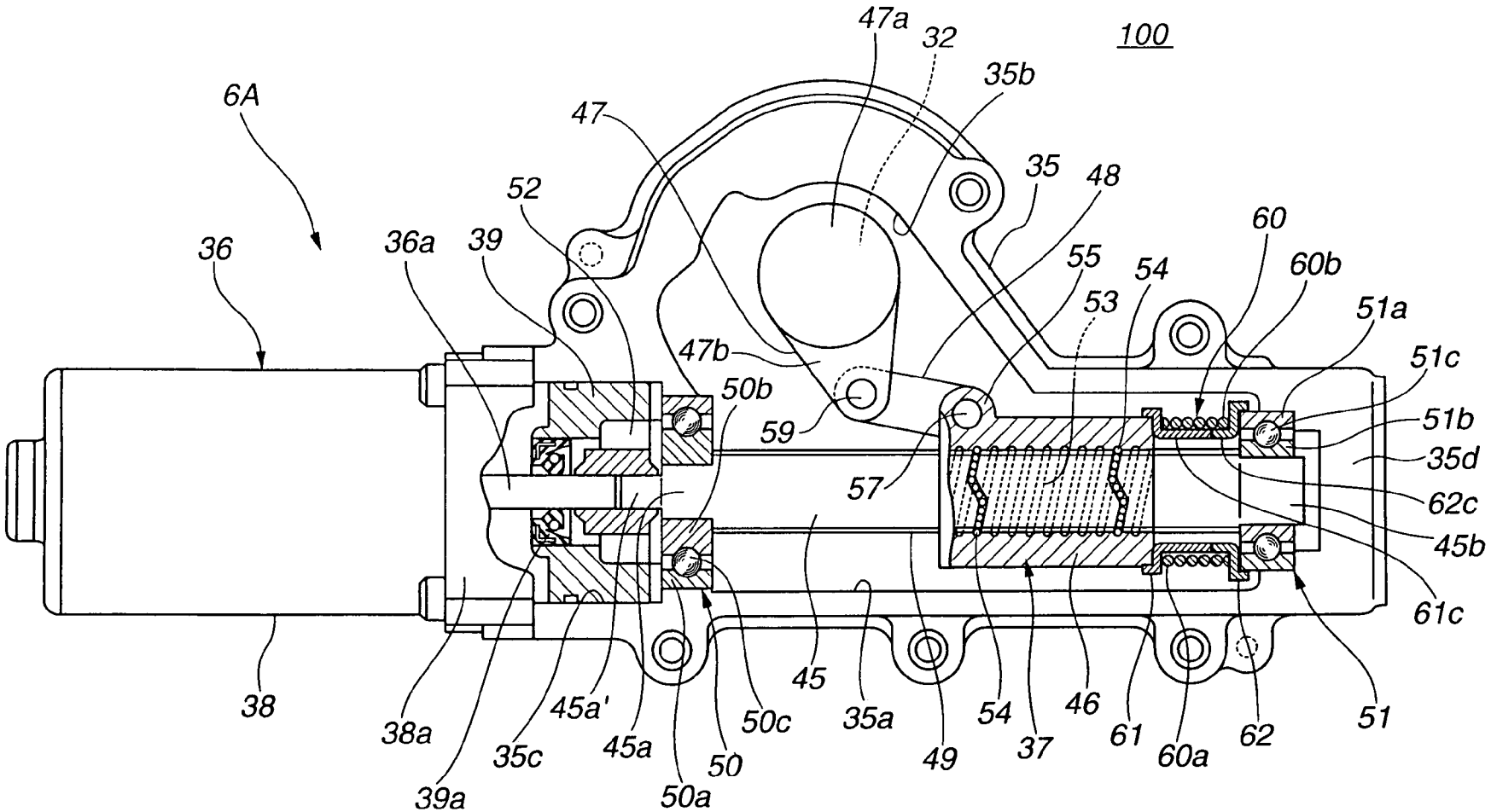
FIG. 2 is a view similar to FIG. 1, but showing a different condition of the actuating mechanism.

As is seen from FIGS. 1 and 2, ball-nut 46 is formed with a round projection 55 to which a lower end of the above-mentioned link member 48 is pivotally connected through a pivot pin 57. As shown in FIGS. 5 and 6, at axially opposite sides of round projection 55, ball-nut 46 is formed with curved cuts 56 which permit a swing movement of round lower ends of link member 48. That is, as is seen from FIG. 6, due to provision of the curved cuts 56 on ball-nut 46, there is defined a round clearance "c" between the bottom of each curved cut 56 and the corresponding round lower end of link member 48.

As is seen from FIGS. 1 to 5, connecting arm 47 is generally triangular in shape and comprises a larger base portion 47*a* that is secured to the end of control shaft 32, and an arm portion 47*b* that extends radially outward from larger base portion 47*a*.

As is seen from FIG. 1, arm portion 47*b* of connecting arm 47 is pivotally connected to an upper end of link member 48 through a pivot pin 59.

Link member 48 has a generally U-shaped cross section and is produced by pressing a flat metal plate. That is, link member 48 comprises two parallel wall portions and a bridge portion that extends between the two parallel wall portions.

As is seen from FIG. 1, for the pivotal connection between the upper end of link member 48 and arm portion 47*b* of connecting arm 47 by means of pivot pin 59, the arm portion 47*b* is sandwiched between upper sections of the two parallel wall portions, and as is seen from FIG. 5, for the pivotal connection between the lower end of the link member 48 and round projection 55 of ball-nut 46 by means of pivot pin 57, the round projection 55 is sandwiched between lower sections of the two parallel wall portions.

Thus, as is understood from FIGS. 1 and 2, under movement of ball-nut 46 along ball-screw shaft 45, link member 48 is forced to pivot about round projection 55 pulling or pushing connecting arm 47.

The above-mentioned rotation angle sensor 44 is a known one, which is placed at a position facing the larger base portion 47*a* of connecting arm 47, as is understood from FIG. 5. That is, a sensor part 44*a* of sensor 44 senses an angular position of a sensor pin (not shown) mounted in larger base portion 47*a* of connecting arm 47 and issues a corresponding information signal to the above-mentioned control unit 40.

Referring back to FIG. 1, between a right end of ball-nut 46 and outer race 51*a* of right ball bearing 51, there is compressed a coil spring 60 in order to bias ball-nut 46 leftward, that is, toward left ball bearing 50. Denoted by reference "L" is a length of coil spring 60, that reduces when ball-nut 46 moves rightward.

It is to be noted that coil spring 60 is arranged to exert such biasing force even when ball-nut 46 assumes the leftmost position, that is, a position to induce the minimum lift degree of intake valves 2 and 2. As shown, a left end 60*a* of coil spring 60 is retained by a left spring retainer 61 held by the right end of ball-nut 46, and a right end 60*b* of coil spring 60 is retained by a right spring retainer 62 held by the outer race 51*a* of right ball bearing 51.

Figure 3:
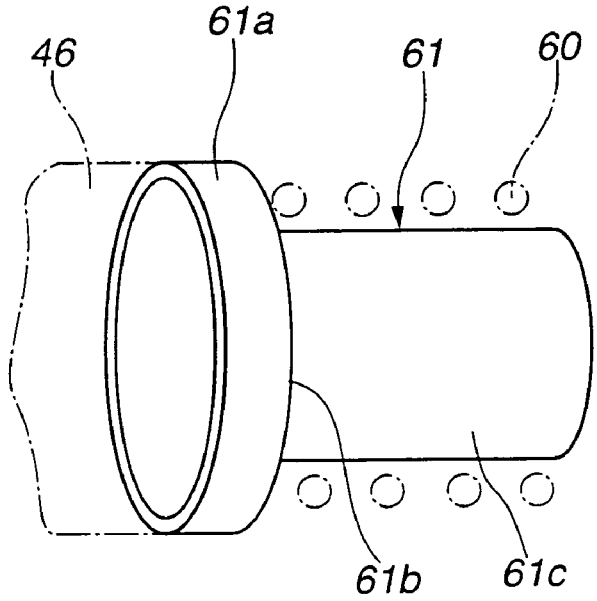
FIG. 3 is a perspective view of a left (or first) spring retainer employed in the actuating mechanism of the variable valve system of the first embodiment.
Figure 4:
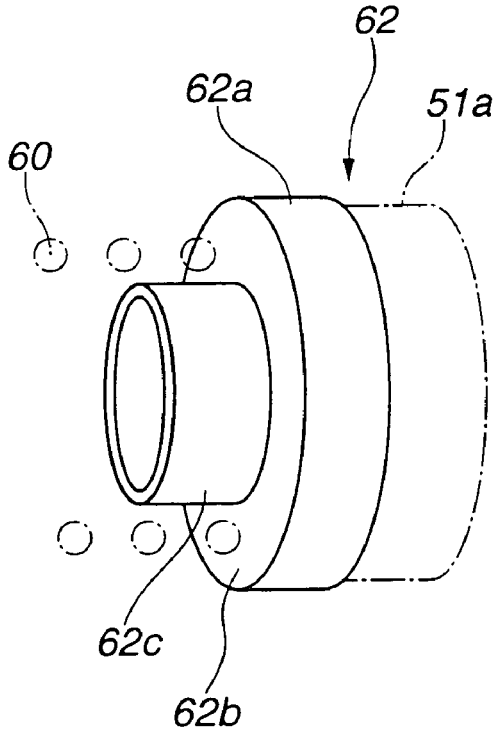
FIG. 4 is a perspective view of a right (or second) spring retainer employed in the actuating mechanism of the variable valve system of the first embodiment.

As is seen from FIGS. 3 and 4, left and right spring retainers 61 and 62 are cylindrical in shape and each produced by pressing a metal plate.

That is, as is seen from FIG. 3, left spring retainer 61 comprises a larger diameter annular base portion 61*a* that is sized to receive therein the right end of ball-nut 46, a smaller diameter cylindrical portion 61*c* that coaxially extends rightward from the base portion 61*a*, and an annular flat wall portion 61*b* that radially inwardly extends from a right end of the annular base portion 61*a* to a left end of cylindrical portion 61*c*. In order to facilitate insertion of cylindrical portion 61*c* into coil spring 60, the cylindrical portion 61*c* is slightly tapered toward the leading end.

While, as is seen from FIG. 4, right spring retainer 62 comprises a larger diameter annular base portion 62*a* that is sized to receive therein the left end of outer race 51*a* of right ball bearing 51, a smaller diameter cylindrical portion 62*c* that coaxially extends leftward from the base portion 62*a*, and an annular flat wall portion 62*b* that extends radially inward from a left end of the annular base portion 62*a* to a right end of the cylindrical portion 62*c*. In order to facilitate insertion of cylindrical portion 62*c* into coil spring 60, the cylindrical portion 62*c* is slightly tapered toward the leading end. As shown, the axial length of cylindrical portion 62*c* is shorter than that of cylindrical portion 61*c* of left spring retainer 61.

It is to be noted that, as is seen from FIG. 2, coil spring 60 is arranged to exert the biasing force normally without inducing undesired contact between adjacent coil loops of coil spring 60 even when ball-nut 46 assumes the rightmost position, that is, a position to induce the maximum lift degree of intake valves 2 and 2.

In the following, operation of variable valve system 100 of the first embodiment will be described with reference to the drawings, particularly FIGS. 1, 2, 5 and 6.

For ease of understanding, the description on the operation will be commenced with respect to a condition wherein the engine runs at a lower speed, such as a speed in case of idling.

In such case, as is seen from FIG. 5, electric motor 36 is actuated in accordance with an instruction signal outputted from control unit 40. As is seen from FIG. 6, upon this, a torque produced by electric motor 36 is transmitted to ball-screw shaft 45 to rotate the same. With this, as is understood from FIG. 1, ball-nut 46 is moved axially leftward along ball-screw shaft 45 allowing fine balls 54 to run in and along a passage that is defined by and between spiral thread 53 of ball-nut 46 and spiral thread 49 of ball-screw shaft 45. That is, ball-nut 46 is moved toward electric motor 36 in FIG. 1.

Accordingly, as is seen from FIG. 1, connecting arm 47 and thus control shaft 32 are turned clockwise in this drawing. That is, control shaft 32 is rotated counterclockwise in FIGS. 5 and 9A.

Figure 9B:
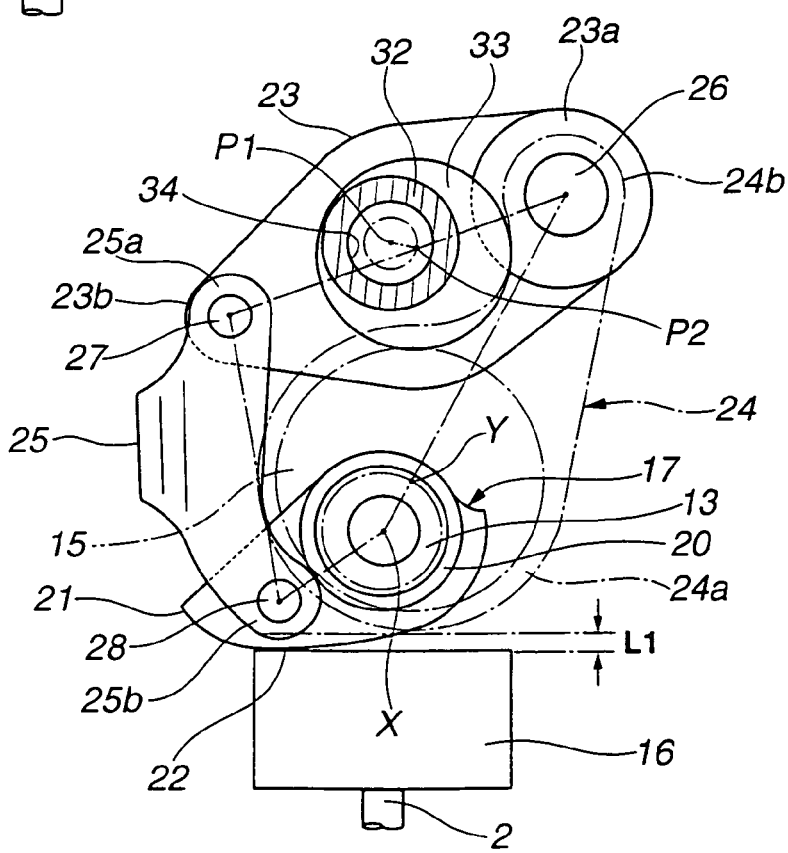

Upon this, as is seen from FIGS. 9A and 9B, control cam 33 is turned counterclockwise about the axis "P1" of control shaft 32 moving the thickest cam part thereof upward away from drive shaft 13, and finally control cam 33 takes the angular position as shown in these drawings. In other words, in this case, the entire construction of rocker arm 23 takes a relatively high position. Thus, under this condition, as is seen from FIG. 9A, the uppermost position that can be taken by pivot pin 27 provided between the left wing part 23*b* of rocker arm 23 and upper end 25*a* of link rod 25 is a first position that is remote from drive shaft 13. This means that as is seen from FIGS. 9A and 9B, under operation of the variable valve system, link rod 25 and thus swing cam 17 are forced to operate at a position remote from valve lifter 16.

Figure 11:
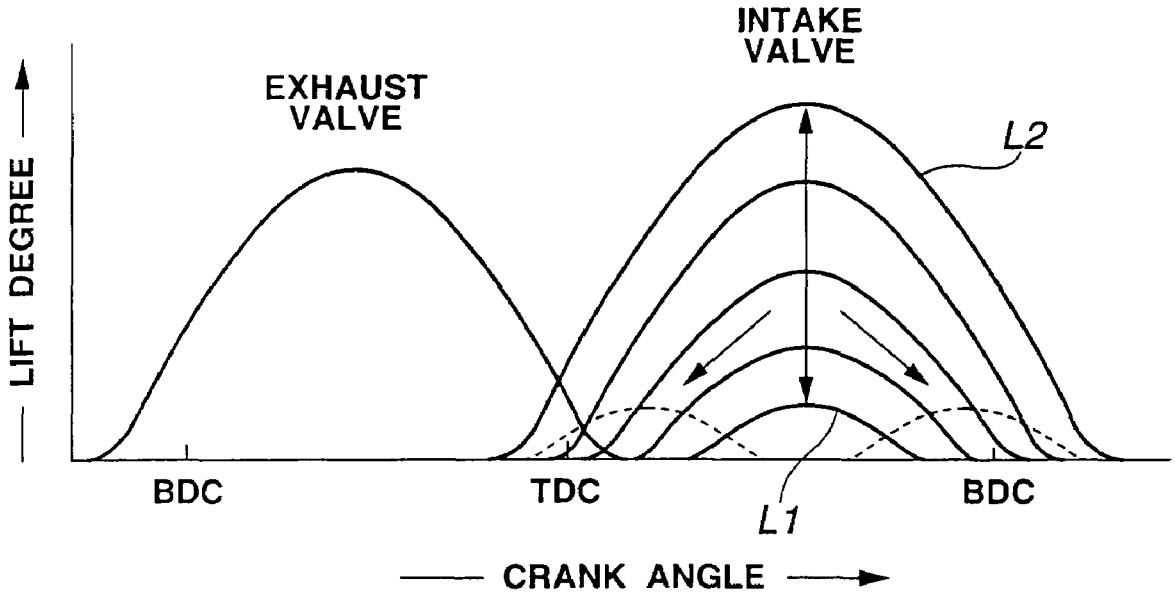
FIG. 11 is a graph showing a valve lift characteristic of each intake valve, which is induced by the variable valve system of the present invention.

Accordingly, when, due to rotation of drive shaft 13, drive cam 15 is rotated in annular base portion 24*a* of link arm 24, rocker arm 23 is forced to swing reciprocating link rod 25 and swing cam 17 at such a position remote from valve lifter 16. That is, as is understood from FIG. 9B, under this condition, the valve lift shows the smallest degree "L1" inducing a retarded open timing of intake valves 2 and 2 thereby minimizing the over wrap degree with the associated exhaust valves. Thus, improved fuel consumption and stable running of the engine are obtained under such lower speed condition of the engine. In FIG. 11, reference "BDC" indicates a bottom dead center and reference "TDC" indicates a top dead center.

In such low speed operation of the engine, alternating torque applied to control shaft 32 is sufficiently small, and thus, a load transmitted to ball-nut 46 through connecting arm 47 and link member 48 is sufficiently small. Thus, a stress applied to both spiral thread 53 of ball-nut 46 and spiral thread 49 of ball-screw shaft 45 is very small, which prevents undesired frictional wear of fine balls 54 and spiral threads 53 and 49.

While, when the engine is subjected to a high speed operation, control unit 40 (see FIG. 5) controls electric motor 36 to run in a reversed direction. As is seen from FIG. 2, upon this, ball-nut 46 is moved rightward. That is, ball-nut 46 is moved away from electric motor 36 in FIG. 5.

Accordingly, as is seen from FIG. 2, connecting arm 47 and thus control shaft 32 are turned counterclockwise in the drawing. That is, control shaft 32 is rotated clockwise in FIGS. 5 and 9A.

Figure 10A:
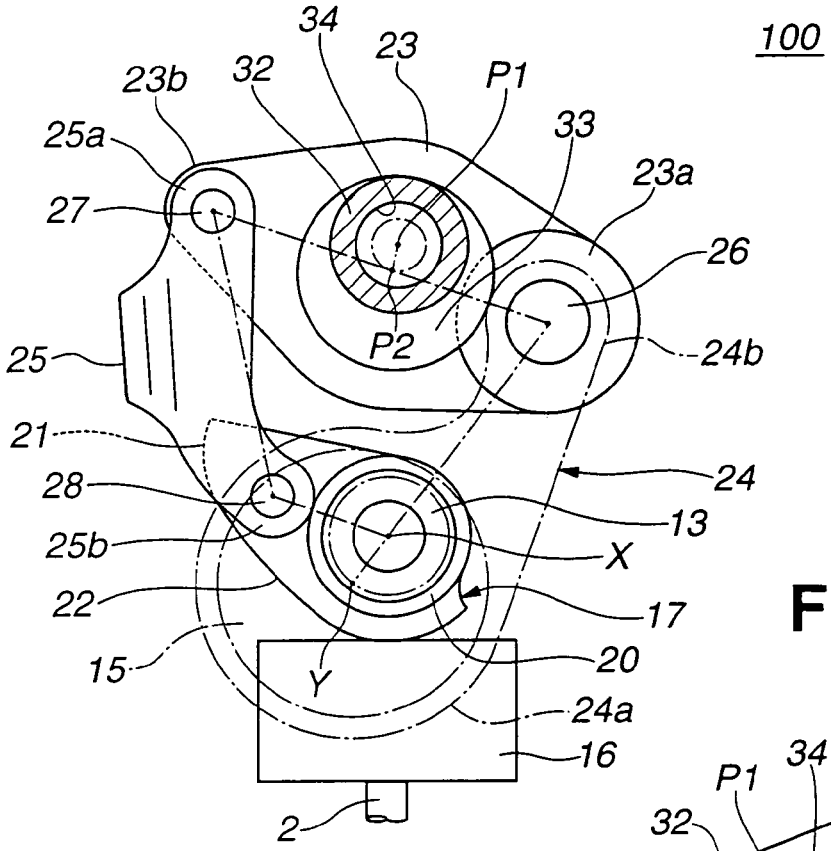
Figure 10B:
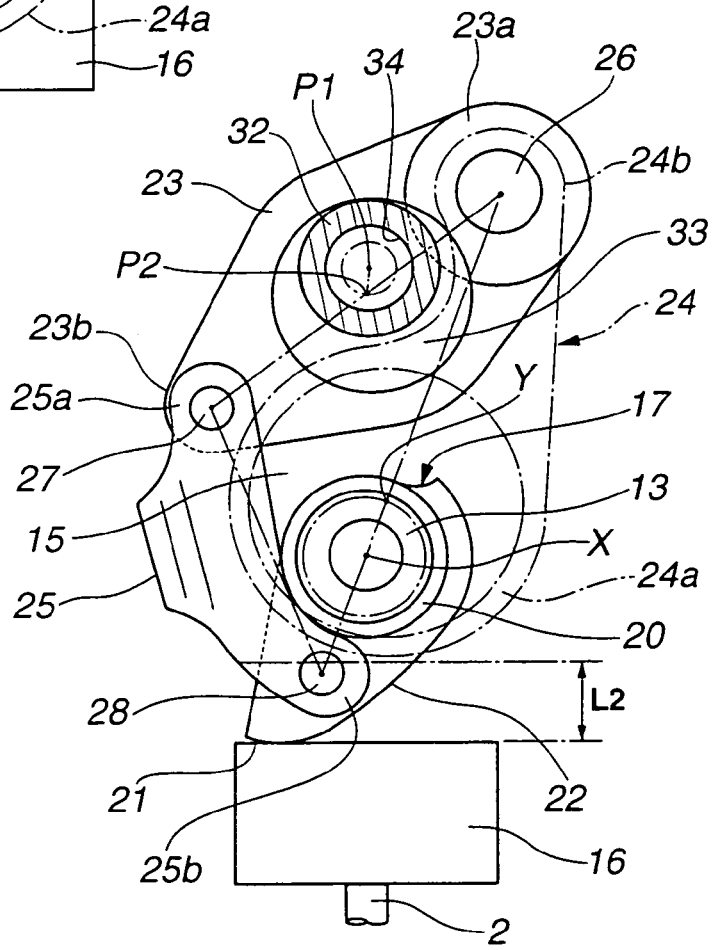

Upon this, as is seen from FIGS. 9A, 10A and 10B, control cam 33 is turned clockwise about the axis "P1" of control shaft 32 moving the thickest cam part thereof downward toward drive shaft 13, and finally control cam 33 takes the angular position as shown in FIGS. 10A and 10B. In other words, in this case, the entire construction of rocker arm 23 takes a relatively low position. Thus, under this condition, as is seen from FIGS. 10A, the uppermost position that can be taken by pivot pin 27 is a second position that is near drive shaft 13 as compared with the above-mentioned first position. This means that as is seen from FIGS. 10A and 10B, under operation of variable valve system, link rod 25 and thus swing cam 17 are forced to operate at a position near valve lifter 16.

Accordingly, when, due to rotation of drive shaft 13, drive cam 15 is rotated in annular base portion 24*a* of link arm 24, rocker arm 23 is forced to swing reciprocating link rod 25 and swing cam 17 at such a position near valve lifter 16. That is, as is seen from FIG. 10B and the graph of FIG. 11, under this condition, the valve lift shows the largest degree "L2". As is seen from the graph of FIG. 11, the close timing of each intake valve 2 is retarded in accordance with an advancement of the open timing. That is, the work angle is increased. Thus, intake air charging efficiency is increased and thus sufficient engine power is obtained in such high speed condition.

In such high speed operation of the engine, alternating torque applied to control shaft 32 is high as compared with the case of the above-mentioned low speed operation. However, since, as is seen from FIG. 2, the angle defined between ball-screw shaft 45 and link member 48 shows a degree sufficiently smaller than that provided in the above-mentioned low speed operation, viz., in case of the smallest lift degree, a radial load is sufficiently depressed, and thus, the larger alternating torque transmitted to ball-nut 46 through connecting arm 47 and link member 48 is entirely received through fine balls 54 by both spiral thread 53 of ball-nut 46 and spiral thread 49 of ball-screw shaft 45. That is, the input load to ball-nut 46 is entirely dispersed in a circumferential direction, and thus undesired concentration of the load can be avoided.

Accordingly, undesired frictional wear of fine balls 54 and spiral threads 53 and 49 is effectively prevented, which improves the durability of such torque transmission device.

As is described hereinabove, the torque of ball-screw shaft 45 is transmitted to ball-nut 46 with the aid of fine balls 54 that roll in the spiral passage defined by spiral thread 53 of ball-nut 46 and spiral thread of ball-screw shaft 45, and thus, the frictional resistance between adjacent parts is reduced, so that the axial movement of ball-nut 46 along ball-screw shaft 45 is smoothed and thus the response of ball-nut 46 to the instruction signal from control unit 40 is improved. That is, the response of operation of intake valves 2 and 2 is improved.

In the following, various advantages provided by provision of the coil spring 60 that biases ball-nut 46 leftward in FIG. 1 will be described with reference to the same drawing.

That is, due to provision of such coil spring 60, undesired backlash of ball-nut 46 relative to ball-screw shaft 45 is suppressed. Accordingly, even when the above-mentioned alternating torque is applied to ball-nut 46, the undesired vibration of ball-nut 46 in the axial direction is suppressed or at least minimized, which suppresses generation of noises caused by such vibration as well as premature wear of the mutually engaged threads of ball-nut 46 and ball-screw shaft 45.

As is seen from FIG. 1, cylindrical portions 61*c* and 62*c* of left and right spring retainers 61 and 62 can serve as a guide means for guiding inner surfaces of coil spring 60. That is, undesired play of coil spring 60 in a radial direction is suppressed or at least minimized, which assures a stable and reliable biasing function of coil spring 60 relative to ball-nut 46.

As is seen from FIG. 2, when coil spring 60 is greatly compressed, leading ends of cylindrical portions 61*c* and 62*c* of left and right spring retainers 61 and 62 contact to each other, which suppresses a further compression of coil spring 60. This means that even when coil spring 60 is almost maximally compressed, coil spring 60 can maintain its normal biasing function keeping a small but certain clearance between adjacent coil loops of coil spring 60. That is, even when coil spring 60 is almost maximally compressed, normal biasing force of coil spring 60 can be applied to ball-nut 46.

As is understood when comparing the conditions of coil spring 60 shown in FIGS. 1 and 2, the biasing force of coil spring 60 increases as ball-nut 46 moves rightward. This means that the biasing force applied to ball-nut 46 increases as the lift degree of intake valves 2 and 2 increases. Accordingly, undesired vibration of ball-nut 46, which would occur at the time when due to the maximum lift degree of intake valves 2 and 2 the largest alternating torque is applied to ball-nut, is assuredly suppressed. While, when the valve lift degree is small, the biasing force produced by coil spring 60 is also small. Accordingly, the response of axial movement of ball-nut 46 to the rotation of ball-screw shaft 45 at the time when the engine is just started is improved.

As is seen from FIG. 1, the biasing force of coil spring 60 is applied through right spring retainer 62 to outer race 51*a* of right ball bearing 51, and at the same time, the biasing force is applied through ball-nut 46 and ball-screw shaft 45 to inner race 51*b* of right ball bearing 51 in a direction axially opposite to the direction in which the biasing force is applied to the outer race 51*a*. Accordingly, outer race 51*a*, inner race 51*b* and balls 51*c* of right ball bearing 51 are biased to one another thereby to suppress or minimize the possibility of backlash of the ball bearing 51.

Due to the biasing force of coil spring 60, inner race 50*b* of left ball bearing 50 is biased leftward in the drawing (FIG. 1). Thus, inner race 50*b*, outer race 50*a* and balls 50*c* of this ball bearing 50 are biased to one another and thus undesired backlash of this bearing 50 is suppressed or at least minimized.

Since the cylindrical portions 61*c* and 62*c* of left and right spring retainers 61 and 62 are each tapered toward the leading end, putting coil spring 60 on these cylindrical portions 61*c* and 62*c* is easily made.

As is understood from FIG. 1, due to the biasing force of coil spring 60, the position of ball-nut 46 that induces the small lift degree of intake valves 2 and 2 is stably held on ball-screw shaft 45. Accordingly, the engine starting easiness is improved.

Since ball-but 46 is constantly applied with the biasing force from coil spring 60, the backlash of ball-nut 46 is assuredly and constantly suppressed or at least minimized irrespective of the position where ball-nut 46 is placed.

Link member 48 is produced by pressing a flat metal plate and thus it has a light weight. Thus, load applied to ball-nut 46 can be reduced.

As is described hereinabove and as is well seen from FIG. 6, round projection 55 for pivotally supporting link member 48 is arranged between the curved cuts 56 and 56. Thus, the round projection 55 can be positioned very close to ball-screw shaft 45, and thus, a unit including ball-nut 46 and link member 48 can have a compact construction. Furthermore, due to integral provision of round projection 55 on ball-nut 46, the mechanical strength of ball-nut 46 is increased.

Figure 12:
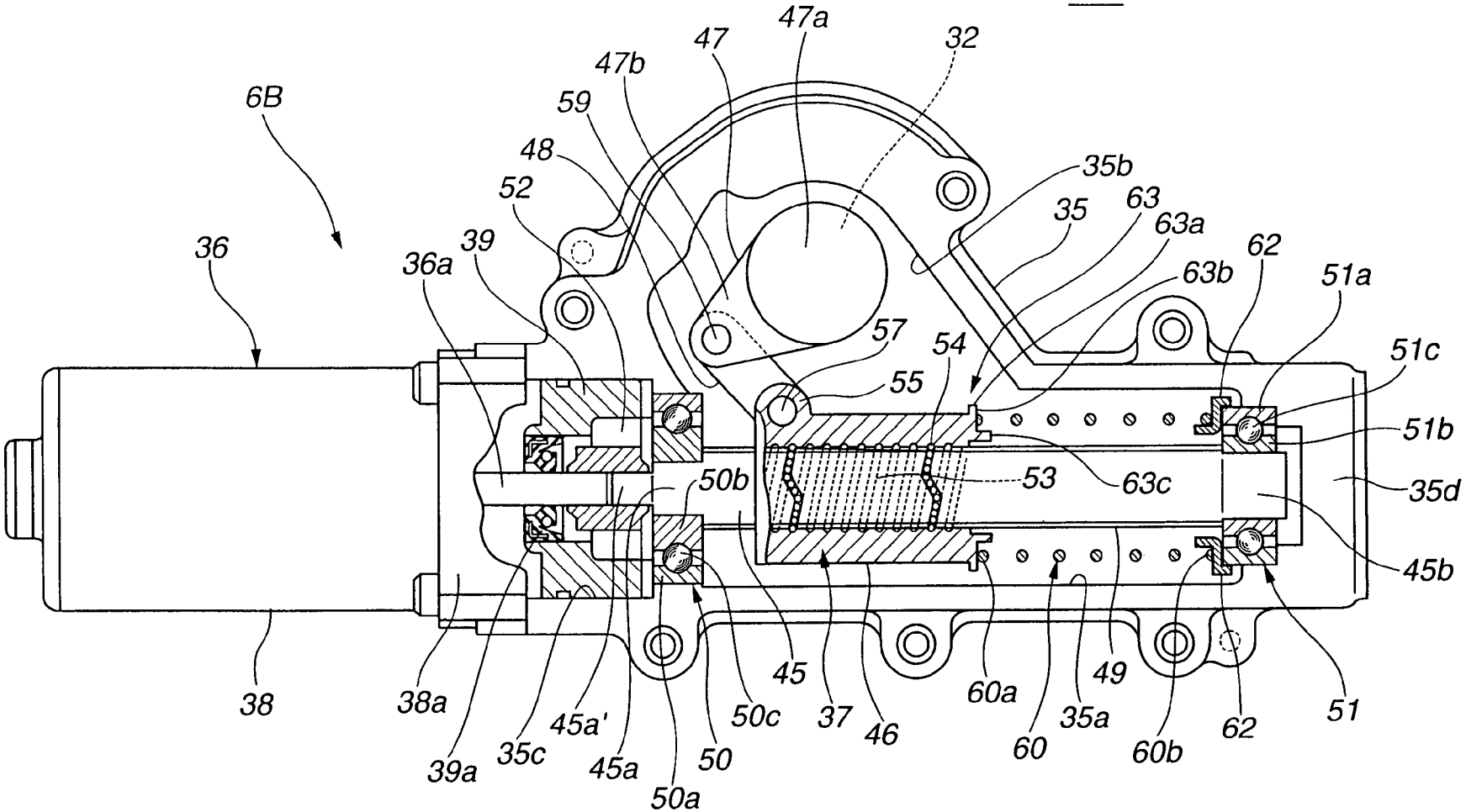
FIG. 12 is a view similar to FIG. 1, but showing an actuating mechanism employed in a variable valve system of a second embodiment of the present invention.
Figure 13:
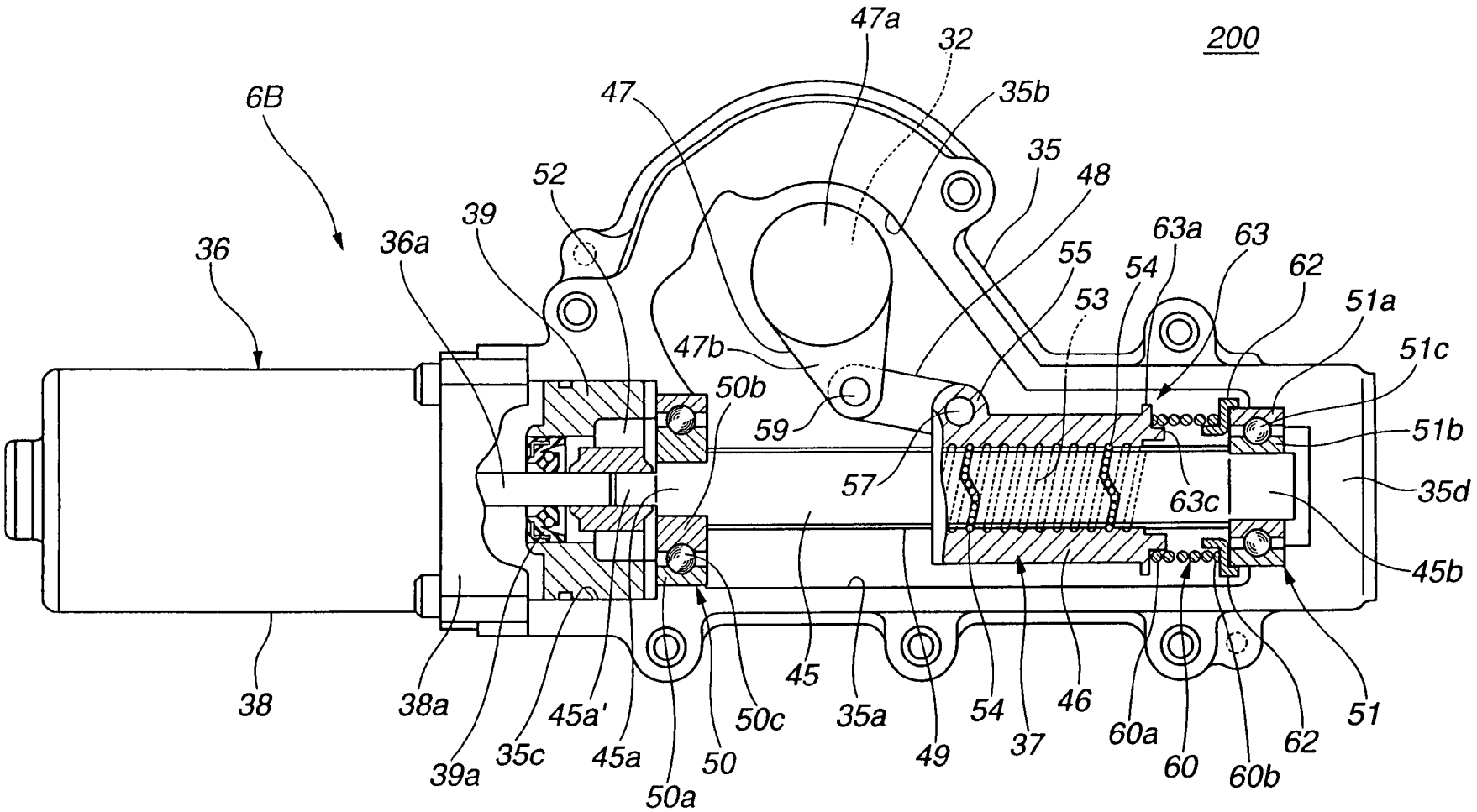
FIG. 13 is a view similar to FIG. 12, but showing a different condition of the actuating mechanism.

Referring to FIGS. 12 and 13, there is shown an actuating mechanism 6B that is employed in a variable valve mechanism 200 of a second embodiment of the present invention. It is to be noted that FIGS. 12 and 13 show conditions that correspond to those of FIGS. 1 and 2, respectively.

Since the actuating mechanism 6B employed in the second embodiment 200 is similar in construction to the above-mentioned actuating mechanism 6A employed in the first embodiment 100, only parts or portions that are different from those of the first embodiment 100 will be described in detail in the following.

As is seen from FIG. 12, in the actuating mechanism 6A, left spring retainer 63 is integrally formed on the right end of ball-nut 46.

That is, as is seen from the drawing, left spring retainer 63 comprises a larger diameter annular base portion 63*a* integrally and concentrically mounted on the right end of ball-nut 46, a smaller diameter cylindrical portion 63*c* that coaxially extends rightward from the base portion 63*a*, and an annular flat wall portion 63*b* that radially inwardly extends from a right end of the annular base portion 63*a* to a left end of cylindrical portion 63*c*.

Because left spring retainer 63 is integral with ball-nut 46, the number of the parts is reduced and thus the production cost is reduced. Due to the similar construction to the actuating mechanism 6A employed in the first embodiment 100, substantially same advantages are equally obtained in the actuating mechanism 6B.

Figure 14:
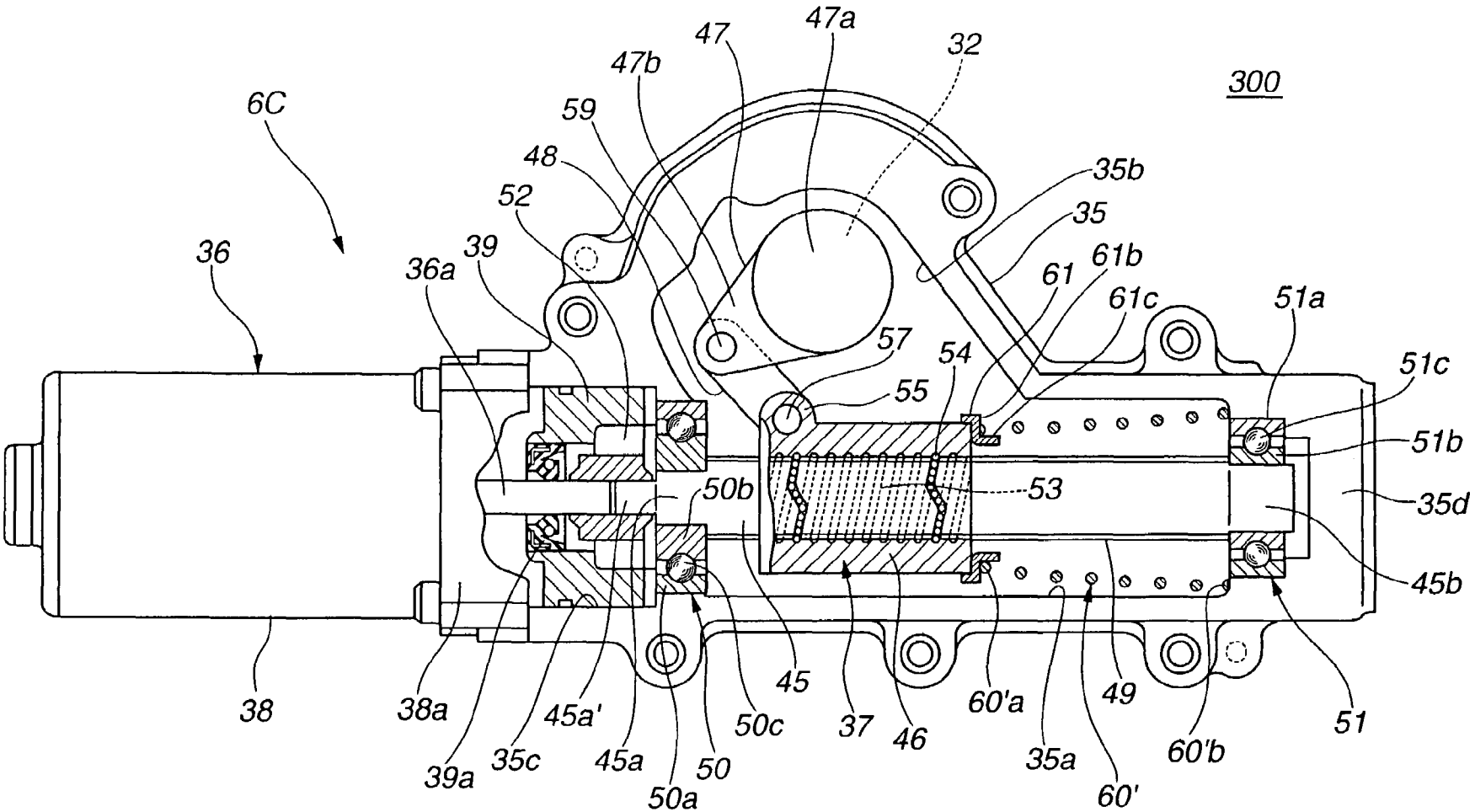
FIG. 14 is a view similar to FIG. 1, but showing an actuating mechanism employed in a variable valve system of a third embodiment of the present invention.
Figure 15:
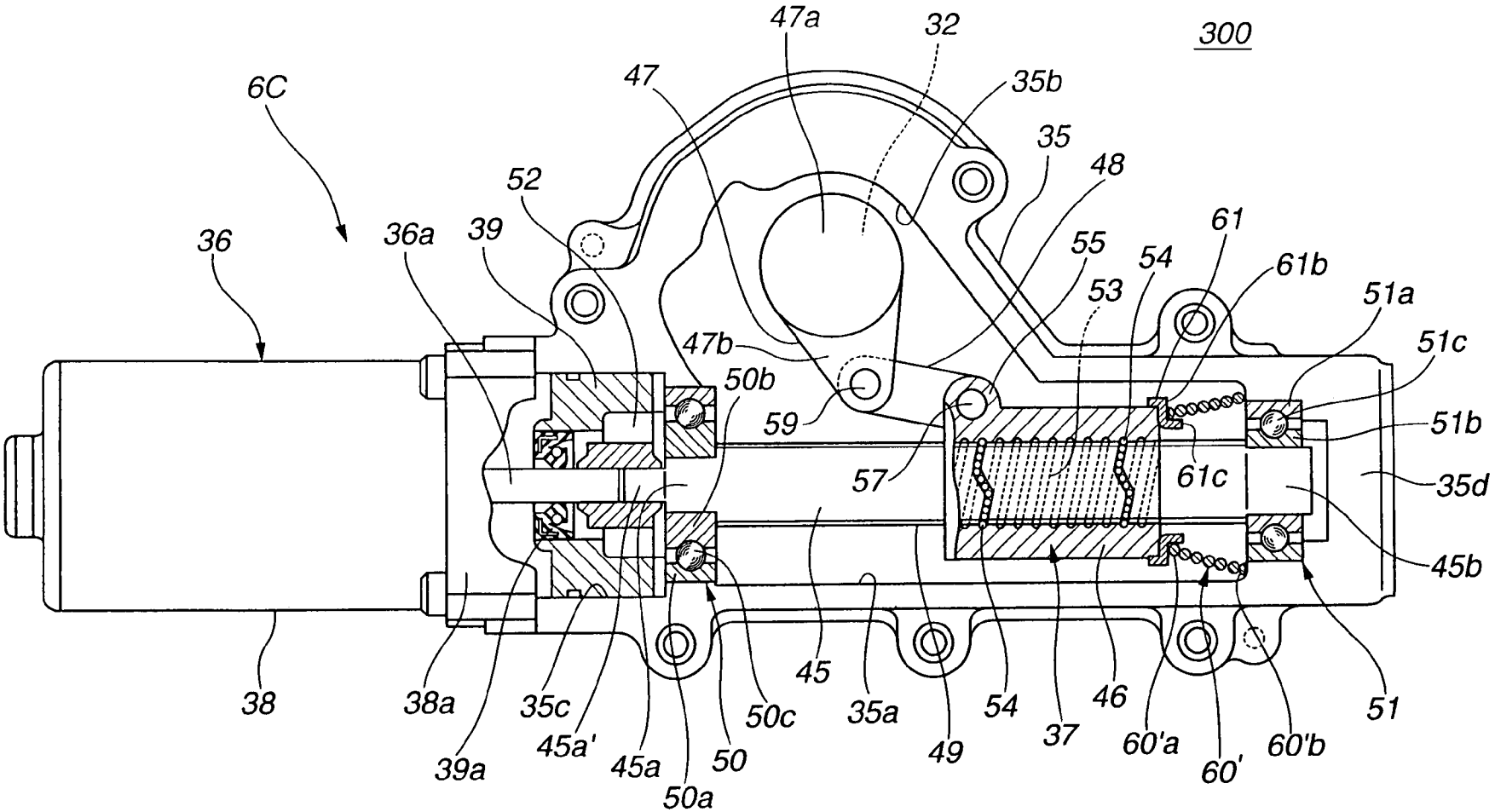
FIG. 15 is a view similar to FIG. 14, but showing a different condition of the actuating mechanism.

Referring to FIGS. 14 and 15, there is shown an actuating mechanism 6C that is employed in a variable valve mechanism 300 of a third embodiment of the present invention. It is to be noted that FIGS. 14 and 15 show conditions that correspond to those of FIGS. 1 and 2, respectively.

For the reasons as described hereinabove, only parts or portions that are different from those of the first embodiment 100 will be described in detail in the following.

As is seen from FIG. 14, in the actuating mechanism 6C employed in the third embodiment 300, a conical coil spring 60' is employed and there is no right spring retainer. That is, conical coil spring 60' has a smaller left end 60'*a* that is held by left spring retainer 61 on ball-nut 46 and a larger right end 60'*b* that abuts on a stepped inner surface of wall 35*d* of elongate lower bore 35*a* of cylindrical housing 35.

Because no separate member is used that corresponds to right spring retainer 62 employed in the first embodiment 100, the number of the parts is reduced and thus the production cost is reduced. Due to the similar construction to the actuating mechanism 6A employed in the first embodiment 100, substantially same advantages are equally obtained in the actuating mechanism 6C.

Figure 16:
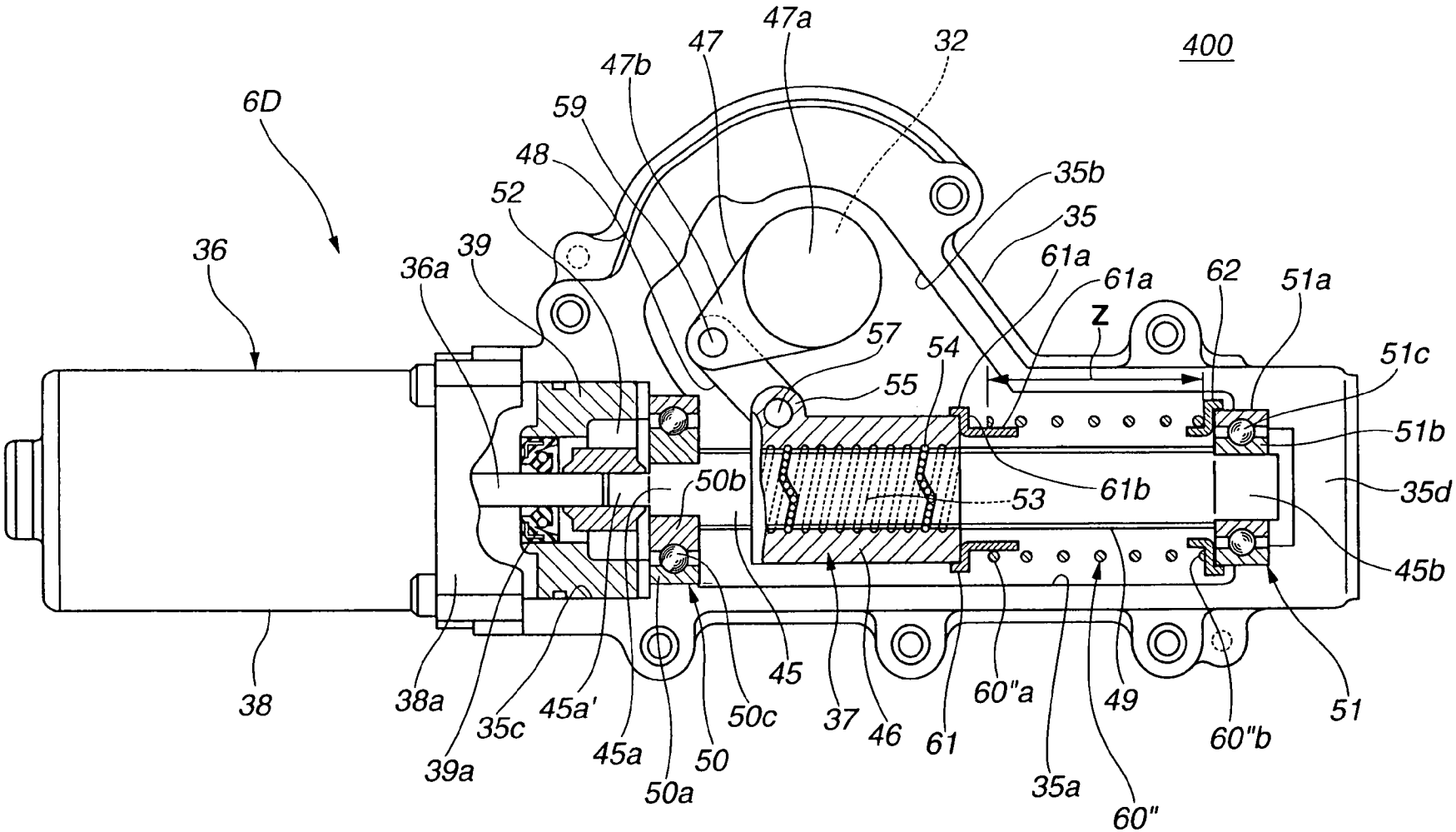
FIG. 16 is a view similar to FIG. 1, but showing an actuating mechanism employed in a variable valve system of a fourth embodiment of the present invention.
Figure 17:
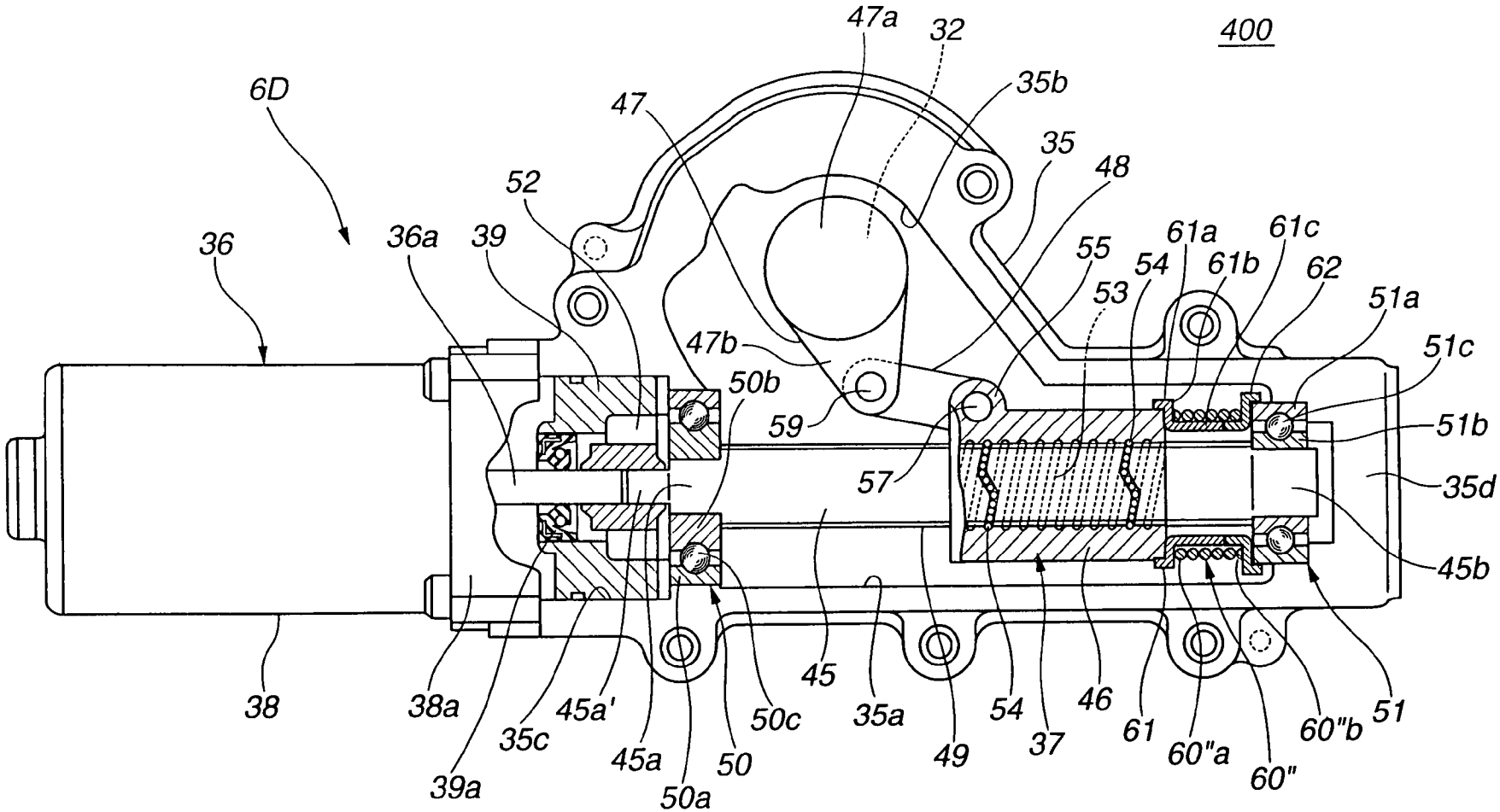
FIG. 17 is a view similar to FIG. 16, but showing a different condition of the actuating mechanism.

Referring to FIGS. 16 and 17, there is shown an actuating mechanism 6D that is employed in a variable valve mechanism 400 of a fourth embodiment of the present invention. It is to be noted that FIGS. 16 and 17 show conditions that correspond to those of FIGS. 1 and 2, respectively.

For the reasons as described hereinabove, only parts or portions that are different from those of the first embodiment 100 will be described in detail in the following.

As is seen from FIG. 16, in the actuating mechanism 6D employed in the fourth embodiment 400, the length "Z" of coil spring 60" is shorter than the length "L" of coil spring 60 of the actuating mechanism 6A employed in the first embodiment 100.

That is, as is seen from FIG. 16, when ball-nut 46 assumes the leftmost position inducing the small lift degree of intake valves 2 and 2, the left end 60"*a* of coil spring 60" is separated by a certain distance from annular flat wall portion 61*b* of left spring retainer 61. It is to be noted that the distance between the left end 60"*a* and the wall portion 61*b* corresponds to the axial movement of ball-nut 46 from a first given position that induces the smallest lift degree of intake valves 2 and 2 to a second given position that is taken just after the corresponding motor vehicle starts to run.

Because of provision of such separation, the biasing force of coil spring 60" is not applied to ball-nut 46 when ball-nut 46 takes a position between the first given position and the second given position, that is, when the engine is operated keeping the lift of intake valves 2 and 2 within a range between the minimum lift degree and a certain smaller degree. Thus, the response of ball-nut 46 at such range is improved.

While, when the engine is operated with the lift degree of intake valves 2 and 2 exceeding such range, the biasing force of coil spring 60" is practically applied to ball-nut 46, and thus, undesired backlash of ball-nut 46 relative to ball-screw shaft 45 is suppressed.

Although the invention has been described above with reference to the embodiments of the invention, the invention is not limited to such embodiments as described above. Various modifications and variations of such embodiments may be carried out by those skilled in the art, in light of the above description.

What is claimed is:

1. A variable valve system for varying both a valve lift degree and a valve open/close timing of an engine valve in accordance with an operation condition of an internal combustion engine, comprising:

a valve lift mechanism that is configured to control the open/close timing of the engine valve with the aid of rotation of a drive shaft;

a valve lift degree varying mechanism that is configured to control an operation position of the valve lift mechanism with the aid of rotation of a control shaft thereby to variably control the valve lift degree of the engine valve;

an actuating mechanism comprising:

a ball-screw shaft that is powered by an electric motor positioned at a first axial side of the ball-screw shaft;

a ball-nut that is operatively disposed on the ball-screw shaft to move along the same; and a transmission mechanism that is configured to produce a rotation movement by using the axial movement of the ball-nut along the ball-screw shaft, wherein the actuating mechanism is configured to control the rotation of the control shaft with the aid of the rotation of the electric motor; and a biasing member arranged to bias the ball-nut in an axial direction relative to the ball-screw shaft.

2. A variable valve system as claimed in claim 1, wherein the biasing member is arranged at a second axial side of the ball-screw shaft to bias the ball-nut toward the electric motor.

3. A variable valve system as claimed in claim 2, wherein the biasing member is a coil spring disposed about the ball-screw shaft.

4. A variable valve system as claimed in claim 1, wherein the transmission mechanism comprises:

a connecting arm that is rotatable together with the control shaft; and a link member that pivotally connects the connecting arm and the ball-nut, and wherein the axial movement of the ball-nut along the ball-screw shaft is converted to a rotational movement of the connecting arm, thereby controlling the rotation of the control shaft.

5. A variable valve system as claimed in claim 1, wherein the valve lift mechanism and the valve lift degree varying mechanism comprise:

a swing cam swingably disposed about the drive shaft to open and close the engine valve;

a rocker arm pivotally disposed about the control shaft;

a link rod pivotally connecting the swing cam and the rocker arm; and a drive cam secured to the drive shaft and mechanically connected to the rocker arm, and wherein a swing fulcrum of the rocker arm is varied in accordance with the operation condition of the engine, thereby variably controlling the valve lift degree of the engine valve through the swing cam.

6. A variable valve system as claimed in claim 5, further comprising a link arm operatively disposed about the drive cam and operatively connected to the rocker arm.

* * * * *